US007497723B2

(12) United States Patent
Brassell et al.

(10) Patent No.: US 7,497,723 B2
(45) Date of Patent: Mar. 3, 2009

(54) HIGH-VOLTAGE ELECTRICAL CONNECTOR WITH VISUAL INDICATOR

(75) Inventors: Robert Brassell, Avon, OH (US); James W. Schmitkons, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 11/763,178

(22) Filed: Jun. 14, 2007

(65) Prior Publication Data

US 2008/0311779 A1 Dec. 18, 2008

(51) Int. Cl.
*H01R 13/52* (2006.01)

(52) U.S. Cl. ..... 439/489; 439/910

(58) Field of Classification Search ..... 439/489, 439/910

See application file for complete search history.

(56) References Cited

U.S. PATENT DOCUMENTS

| | | | | |
|---|---|---|---|---|
| 3,552,777 | A | 1/1971 | Heinrich et al. | |
| 3,786,396 | A | 1/1974 | Kemmer et al. | |
| 3,850,495 | A | 11/1974 | Glover | |
| 4,290,662 | A | 9/1981 | Storcel | |
| 4,605,272 | A | 8/1986 | Myers et al. | |
| 4,978,317 | A | 12/1990 | Pocrass | |
| 5,556,287 | A * | 9/1996 | Kuhn et al. | 439/89 |
| 5,685,737 | A | 11/1997 | Morin et al. | |
| 5,795,180 | A * | 8/1998 | Siebens | 439/489 |
| 5,823,811 | A | 10/1998 | Blanchfield et al. | |
| 6,504,103 | B1 * | 1/2003 | Meyer et al. | 174/167 |
| 6,561,841 | B2 | 5/2003 | Norwood et al. | |
| 6,921,283 | B2 * | 7/2005 | Zahlit et al. | 439/489 |
| 6,984,791 | B1 * | 1/2006 | Meyer et al. | 174/167 |

OTHER PUBLICATIONS

Nordson Corporation, CW610 Lamphead With Unicable, Product Manual, issued Jan. 2007, Lamphead Cable Connections, Section 3-5.

* cited by examiner

*Primary Examiner*—Gary F. Paumen
(74) *Attorney, Agent, or Firm*—Wood, Herron & Evans, L.L.P.

(57) ABSTRACT

An electrical connector includes a receptacle and a plug. The receptacle includes a tubular housing having an axial bore and at least one electrical contact within the bore. The plug is received in the bore of the receptacle housing and includes a tubular core having an axial bore and at least one electrical contact that engages the electrical contact on the receptacle when the plug is coupled to the receptacle. The plug further includes a rotatable collar for securing the plug to the receptacle. A visual indicator on at least one of the plug core or the receptacle housing is visible through a window in the collar to provide a visual indication when the plug is fully coupled to the receptacle.

9 Claims, 4 Drawing Sheets

HIGH-VOLTAGE ELECTRICAL CONNECTOR WITH VISUAL INDICATOR

TECHNICAL FIELD

The present invention relates to electrical connectors, and more particularly to an electrical connector for use with high-voltage applications.

BACKGROUND

Electrical connectors are used in various applications to facilitate the transmission of power and data between components of an electrical system. Conventional electrical connectors include plug and receptacle portions that may be coupled together to provide a secure connection of wire leads extending between components. The plug and receptacle portions each include one or more electrical contacts in the form of pins or other structure. The electrical contacts are soldered, crimped, or otherwise joined to the individual wire leads. In some applications, such as ultraviolet curing equipment or other industrial equipment, power is provided by cables that are coupled to the equipment by high-voltage electrical connectors. In these applications, it is important to insure that the electrical contacts are fully engaged with one another, without leaving an air gap, to prevent arcing of electrical current between the electrical contacts of the plug and receptacle portions.

A drawback of conventional connectors is that it is often difficult to determine whether the plug and receptacle portions are fully coupled together, with their respective contacts securely engaging one another. A need therefore exists for an electrical connector that facilitates ready determination of a proper connection between the plug and receptacle portions.

SUMMARY

In one embodiment in accordance with the present disclosure, a plug for use in an electrical connector having a receptacle for receiving the plug includes a tubular core having an outer circumference, and interior bore, and a longitudinal axis extending through the bore. At least one electrical contact is disposed in the bore for engaging a corresponding electrical contact on the receptacle. The plug further includes a collar coupled to the outer circumference of the core. The collar is rotatable about the longitudinal axis and is adapted to secure the plug to the receptacle. A visual indicator on the outer circumference of the core is positioned for underlying registration with a window on the collar and cooperates with the window to provide a visual indication when the plug is fully coupled to the receptacle.

In one aspect, the visual indicator is positioned to be visible through the window on the collar when the plug is not fully coupled to the receptacle. After the plug is fully coupled to the receptacle, the visual indicator will be blocked from view by the receptacle. For example, the receptacle may include a tubular housing that receives the core of the plug. When the plug is fully coupled to the receptacle, a terminal end of the housing may cover the visual indicator, blocking it from being viewed through the window in the collar.

In another embodiment, a connector in accordance with the present disclosure includes a receptacle and a plug configured to be coupled to the receptacle. In one aspect, the receptacle includes a tubular housing having an axial bore and at least one electrical contact within the axial bore. The plug includes a tubular core having an axial bore with at least one electrical contact therein. The electrical contact of the plug is adapted to engage the electrical contact on the receptacle when the plug is coupled to the receptacle. The plug also includes a collar rotatably coupled to the core and adapted to secure the plug to the receptacle. The connector further includes a visual indicator on at least one of an outer circumference of the receptacle housing or the plug core. The visual indicator is positioned for underlying registration with a window on the collar and cooperates with the window to provide a visual indication when the plug is fully coupled to the receptacle.

In another aspect in accordance with the present disclosure, a method of coupling a plug and a receptacle of an electrical connector includes inserting the plug into the receptacle, rotating a collar on the plug to engage a corresponding surface on the receptacle, and viewing a change in color through a window in the collar to determine whether the plug is fully coupled to the receptacle.

These and other features, objects and advantages will become more readily apparent to those skilled in the art in view of the following detailed description, taken in conjunction with the accompanying drawings.

DETAILED DESCRIPTION

Figure 1:
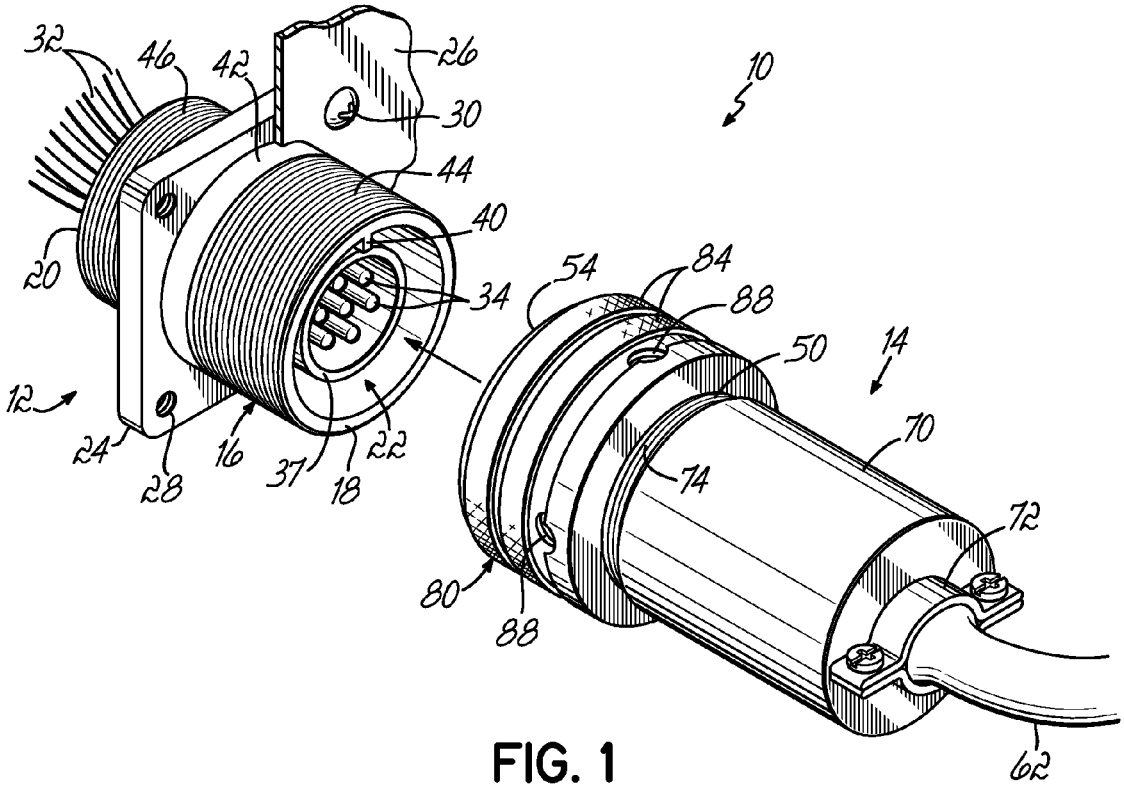
FIG. 1 is a perspective view of an exemplary electrical connector in accordance with the present disclosure, in an uncoupled condition.
Figure 3A:
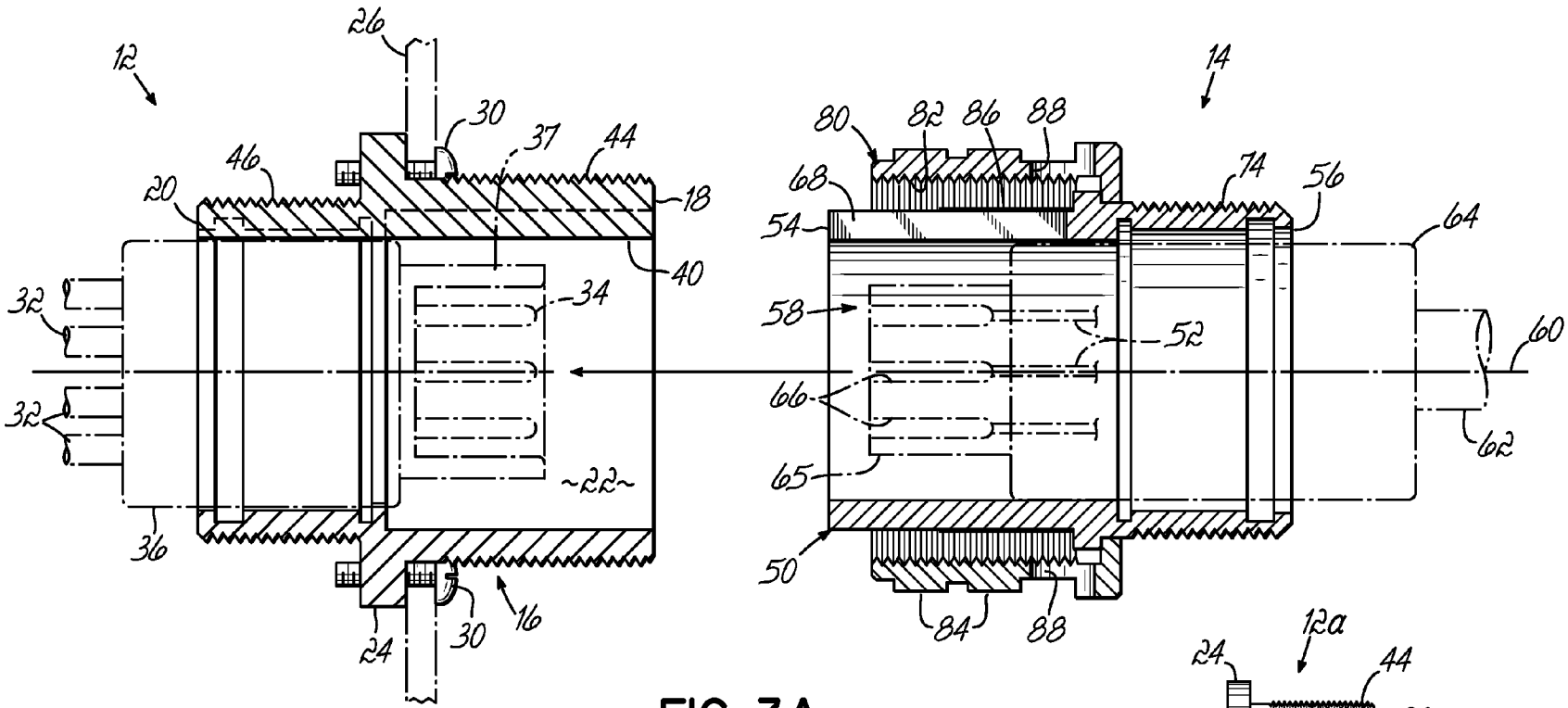
FIG. 3A is a cross-sectional view of the uncoupled electrical connector of FIG. 1.

FIGS. 1 and 3A depict an exemplary electrical connector 10 in accordance with the present disclosure. The electrical connector 10 includes a receptacle 12 and a plug 14 that may be selectively coupled together to provide a secure electrical connection. The receptacle 12 includes a generally tubular housing 16 having a first end 18, a second end 20, and an axial bore 22 extending between the first and second ends 18, 20. A mounting flange 24 extends radially outward from the housing 16 at a location intermediate the first and second ends 18, 20 for securing the receptacle housing 16 to a bulkhead panel 26 of an item of electrical hardware. Apertures 28 are provided in the mounting flange 24 for securing the receptacle 12 to the bulkhead panel 26 using screws 30 or other fasteners.

Electrical leads 32 from the electrical hardware extend into the bore 22 from the second end 20 and are joined to one or more electrical contacts 34 positioned within the bore 22 of the receptacle housing 16. In the embodiment shown, the electrical contacts 34 are in the form of pins. The electrical contacts 34 are surrounded by an insert 36 of resilient insulating material, such as silicone. The receptacle 12 may further include an annular cowl 37 adjacent the insert 36 to facilitate guiding the electrical contacts 34 into engagement with corresponding electrical contacts 52 on the plug 14, as described below. The electrical contacts 34 may be arranged in a desired pattern for coupling with the corresponding electrical contacts 52 on the plug 14. Accordingly, the receptacle 12 may include key structure 40 provided on the housing 16 to facilitate aligning the plug 14 and the receptacle 12 with a proper orientation such that the respective electrical contacts 34, 52 engage one another when the plug 14 is coupled to the receptacle 12. In the embodiment shown, the key structure 40 is in the form of an elongate ridge projecting radially inward from the housing 16 and extending axially along the bore 22.

The outer circumference 42 of the housing 16 is provided with external threads 44 at the first end 18 to facilitate securely coupling the plug 14 to the receptacle 12, as will be described in more detail below. The second end 20 of the housing 16 may also be provided with external threads 46 to receive a threaded cup or sleeve (not shown) for constraining the electrical leads 32 that extend into the receptacle housing 16. While the receptacle housing 16 has been described as having external threads 44, 46 at the first and second ends 18, 20, it will be appreciated that various other structure suitable for securing a plug 14 or restraining structure to the housing 16 may alternatively be used.

With continued reference to FIGS. 1 and 3A, the electrical connector 10 further includes a plug 14 having a generally tubular core 50 surrounding the electrical contacts 52 that will be engaged with the corresponding electrical contacts 34 of the receptacle 12. The core 50 has first and second ends 54, 56 and an axial bore 58 extending along a longitudinal axis 60 between the first and second ends 54, 56. Electrical leads (not shown) from a cable 62 extend through the second end 56 of the core 50 into the bore 58 and are joined to electrical contacts 52 in a manner similar to that described above with respect to the receptacle 12. In the embodiment shown, the electrical contacts 52 of the plug 14 are also in the form of pins. The electrical contacts 52 may be surrounded by an insert 64 of resilient, insulating material. The plug 14 may further include a guide member 65 adjacent the insert 64 and sized to interconnect with cowl 37 on receptacle 12 to help guide the electrical contacts 34, 52 into engagement. Guide member 65 may include apertures 66 for receiving and guiding the electrical contacts 34 on the receptacle 12 into engagement with the electrical contacts 52 on the plug 14.

A slot 68 is formed in the core 50, near the first end 54, and extends axially toward the second end 56. The slot 68 is configured to receive key structure 40 on receptacle 12 to facilitate orienting the plug 14 and receptacle 12 for proper coupling. While a slot 68 is illustrated in the embodiment, it will be appreciated that various other structure corresponding to key structure 40 and suitable for facilitating proper alignment and orientation of plug 14 and receptacle 12 may alternatively be used.

Figure 2:
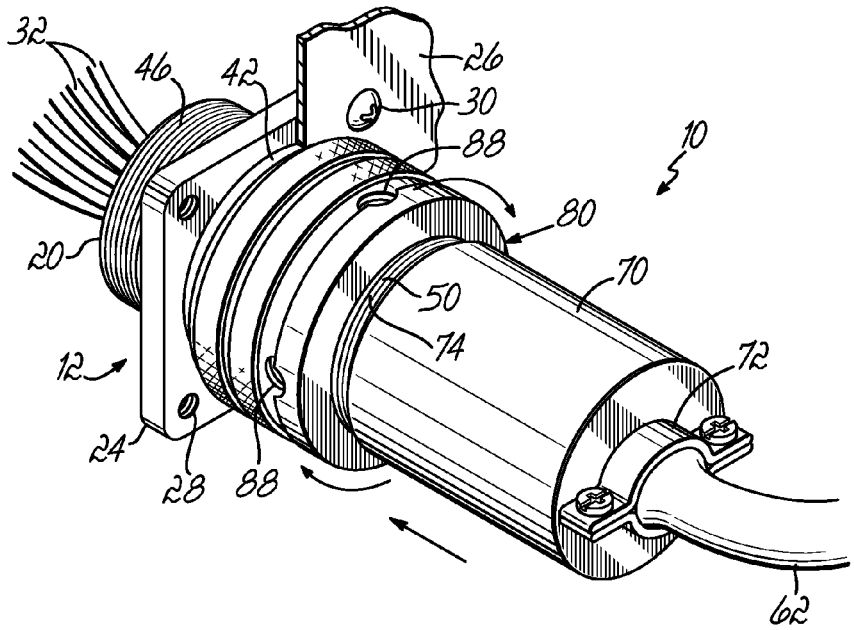
FIG. 2 is a perspective view of the electrical connector of FIG. 1, depicted in a coupled condition.

As shown in FIGS. 1-2, the plug 14 may be provided with a sleeve 70 or other structure, to help secure the cable 62 to the second end 56 of the core 50, and a clamp 72 for providing strain relief between the core 50 and the cable 62. In the embodiment shown, the second end 56 of the core 50 includes external threads 74 and the sleeve 70 includes corresponding internal threads (not shown) that may be threadably coupled together to secure the sleeve 70 to the second end 56 of the core 50. The plug 14 further includes a collar 80 rotatably coupled to the core 50, adjacent the first end 54, for securing the plug 14 to the receptacle 12. In the embodiment shown in FIGS. 3A-3D, the collar 80 includes internal threads 82 corresponding to the external threads 44 provided on the first end 18 of the receptacle housing 16, whereby the first end 54 of the core 50 may be received within the first end 18 of the receptacle housing 16 and the collar 80 may be rotated to threadably engage the first end 18 of the receptacle housing 16 and draw the core 50 into the receptacle housing 16. To facilitate manual rotation of the collar 80, knurled grips 84 are provided on the outer circumference of the collar 80. It will be appreciated, however, that the collar 80 may include other structure suitable to facilitate grasping and rotating the collar 80 to securely couple the plug 14 to the receptacle 12.

To ensure that the electrical contacts 52 on the plug 14 are fully engaged with the electrical contacts 34 on the receptacle 12, the connector 10 is configured to provide a visual indication when the plug 14 is fully coupled to the receptacle 12. In the embodiment shown, the plug 14 includes a colored marking 86 (FIGS. 3A-3D) disposed on the outer circumference of the core 50 to provide visual indication of the fully coupled condition of connector 10. The colored marking 86 is disposed on at least a portion of the outer circumference of the core 50 between the first and second ends 54, 56 and is viewable through one or more windows 88 provided in the collar 80 which is disposed over the first end 54 of the core 50. The window 88 may be an aperture that has a closed peripheral edge, a slot, or any other structure suitable to facilitate viewing the colored marking 86. The colored marking 86 may comprise paint or a separate band of material applied to the outer circumference of the core 50 in the desired location. Alternatively, the outer circumference of the core 50 may be treated, such as by anodizing, for example, or the outer circumference may be machined in such a way that provides visual indication through the windows 88 of the collar 80 that the plug 14 is fully coupled to the receptacle 12.

Figure 3B:
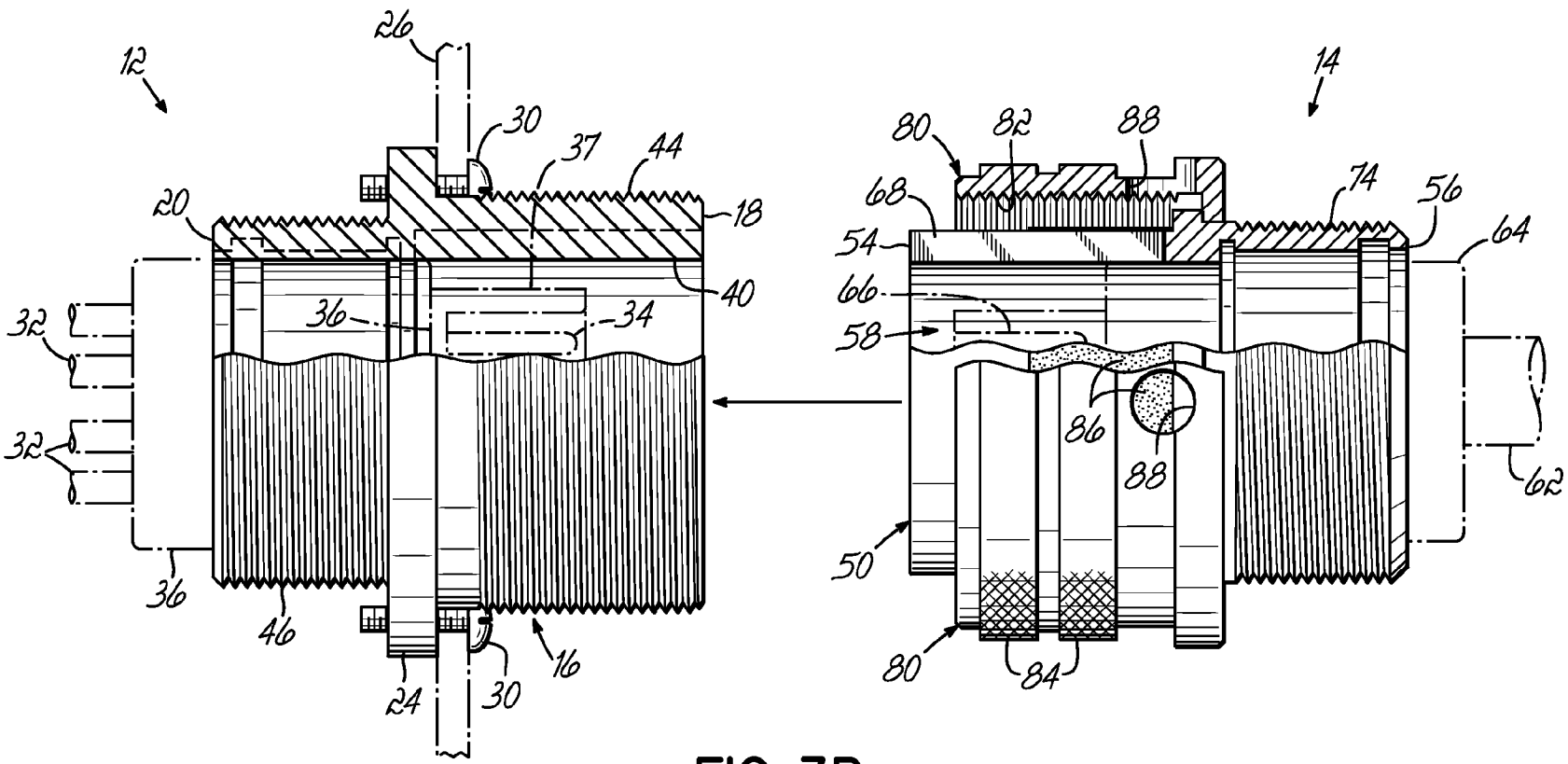
FIG. 3B is a partial cross-sectional view of the uncoupled electrical connector of FIG. 3A.
Figure 3C:
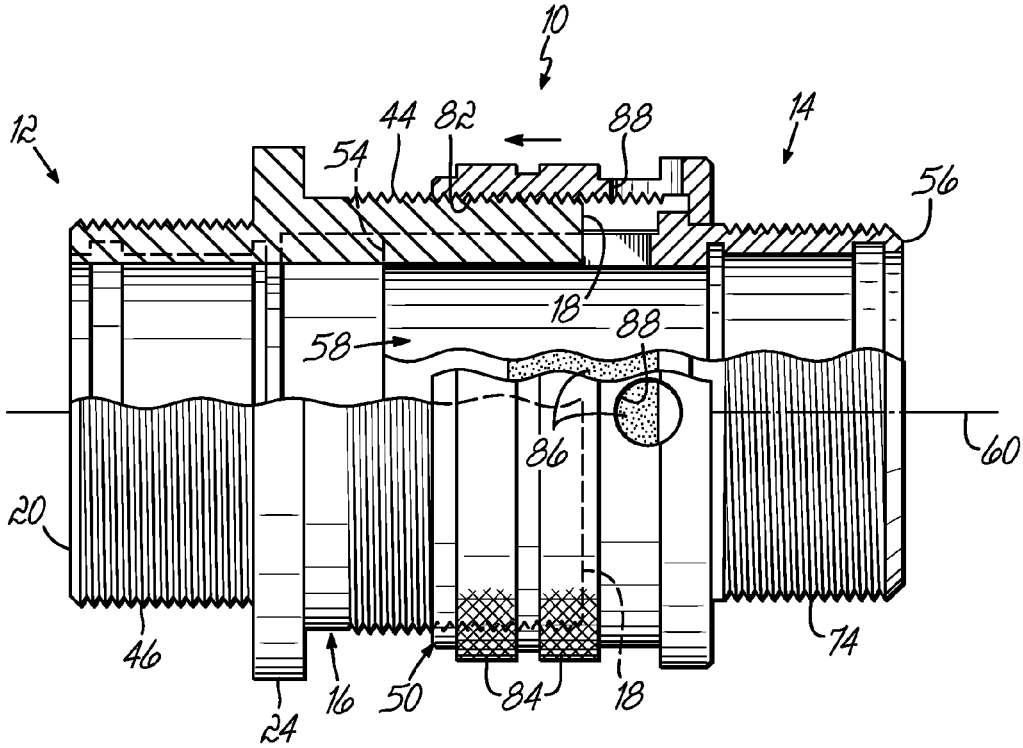
FIG. 3C is a partial cross-sectional view of the electrical connector of FIG. 3B during initial coupling of the connector.
Figure 3D:
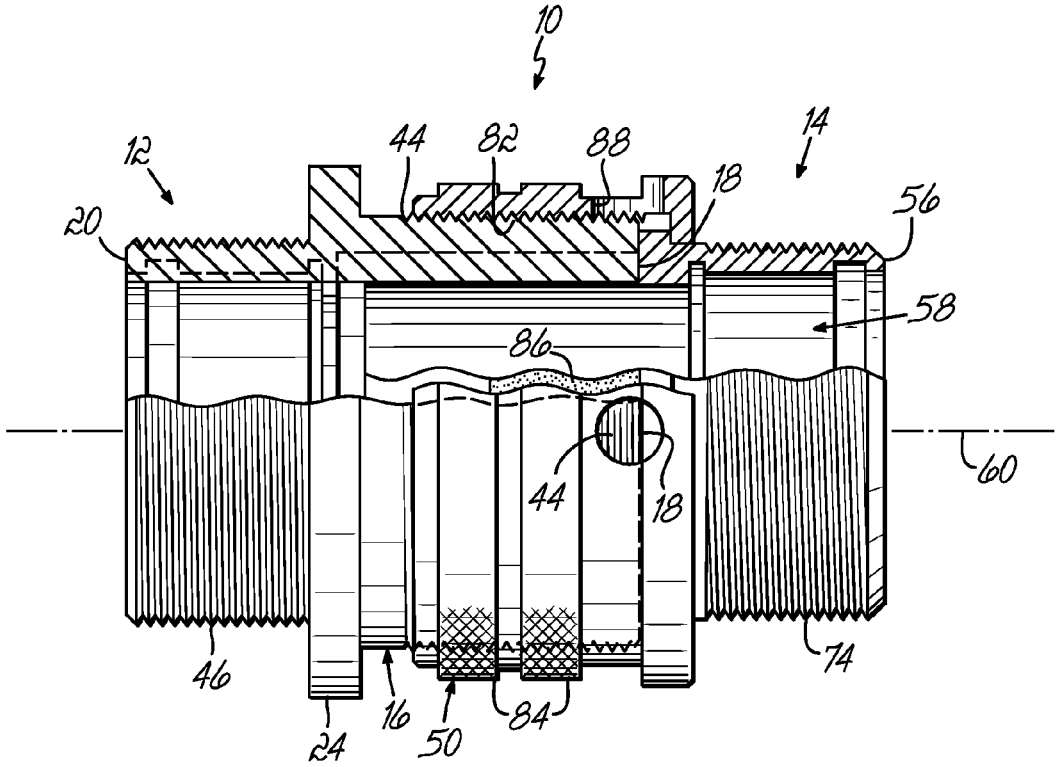
FIG. 3D is a partial cross-sectional view of the electrical connector of FIG. 3B in a fully coupled condition.

In use, the first end 54 of the core 50 is inserted into the first end 18 of the receptacle housing 16 (FIG. 3B) and the collar 80 is rotated to engage the internal threads 82 of the collar 80 with the external threads 44 on the housing 16, thereby drawing the first end 54 of the core 50 further into the housing 16 (FIG. 3C). As the collar 80 is rotated, the first end 18 of the housing 16 moves in a direction toward the second end 56 of the core 50 and gradually extends over the colored marking 86 of the core 50. When the plug 14 is fully coupled to the receptacle 12 such that the corresponding electrical contacts 52, 34 of the plug 14 and receptacle 12 are fully engaged, as depicted in FIG. 3D, the first end 18 of the housing 16 completely covers the visual indicator of core 50, as viewed through the windows 88 in the collar 80, thereby providing users with a visual indication that the connector 10 is fully coupled.

Figure 4:
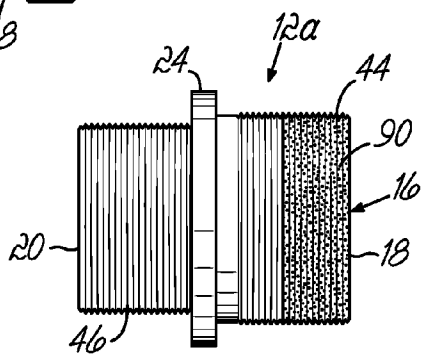
FIG. 4 is an elevation view an alternate embodiment of an electrical connector in accordance with the present disclosure.

While the visual indicator has been shown and described above as a colored marker 86 applied to the outer circumference of the core 50, the visual indicator may alternatively be applied to the outer circumference of the receptacle housing 16, as depicted in FIG. 4. In this embodiment, the visual indicator is a colored marker 90 on the first end 18 of the housing 16 and becomes visible through the windows 88 in the collar 80 when the plug 14 is fully coupled to the receptacle 12 such that the electrical contacts 52 on the plug 14 are fully engaged with the electrical contacts 34 on the receptacle 12.

In yet another embodiment, both the plug 14 and the receptacle 12 may include visual indicators. For example, a colored marker 86 may be provided on the outer circumference of the core 50, and a separate, contrasting colored marker 90 may be provided on the first end 18 of the receptacle housing 16 whereby the colored marker 86 on the core 50 is visible through the window 88 on the collar 80 before the plug 14 is fully coupled to the receptacle 12, and whereafter the contrasting color marker 90 on the first end 18 of the receptacle housing 16 is viewable through window 88 on the collar 80 when the plug 14 is fully coupled to the receptacle 12.

While the present invention has been illustrated by the description of various exemplary embodiments thereof, and while the embodiments have been described in considerable detail, they are not intended to restrict or in any way limit the scope of the appended claims to such detail. The various features discussed herein may be utilized alone or in any combination. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A plug for use in an electrical connector including a receptacle for receiving the plug, the plug comprising:

a tubular core having an outer circumference, an interior bore, and a longitudinal axis extending through said bore;

at least one electrical contact in said interior bore;

a collar coupled to said core about said outer circumference, said collar being rotatable about said longitudinal axis and adapted to secure the plug to the receptacle;

at least one window on said collar; and a visual indicator on said outer circumference of said core, said visual indicator in underlying registration with said window on said collar and cooperating with said window to provide a visual indication when the plug is fully coupled to the receptacle.

2. The plug of claim 1, wherein said visual indicator is positioned to be visible through said window when the plug is not fully coupled to the receptacle, and being blocked from view through said window when the plug is fully coupled to the receptacle.

3. The plug of claim 1, wherein said visual indicator comprises a colored material on at least a portion of said outer circumference of said core.

4. An electrical connector, comprising:

a receptacle comprising:

a tubular housing having an outer circumference and axial bore therethrough, and at least one first electrical contact within said axial bore of said receptacle housing;

a plug received in said axial bore of said receptacle housing, said plus comprising:

a tubular core having an outer circumference, an axial bore, and a longitudinal axis extending through said bore, at least one second electrical contact in said axial bore of said core, said second electrical contact adapted to engage said first electrical contact in said receptacle when said plug is fully coupled to said receptacle, a collar coupled to said core about said outer circumference thereof, said collar being rotatable about said longitudinal axis and adapted to secure said plug to said receptacle, and at least one window on said collar; and a visual indicator on said outer circumference of said core, said visual indicator positioned for underlying registration with said window on said collar, at least in a coupled condition of said receptacle and said plug, and cooperating with said window to provide a visual indication when said plug is fully coupled to said receptacle.

5. The electrical connector of claim 4, wherein said visual indicator is positioned to be visible through said window when said plug is not fully coupled to said receptacle, and being blocked from view through said window when said plug is fully coupled to said receptacle.

6. The electrical connector of claim 4, wherein said visual indicator comprises a colored material on at least a portion of said outer circumference of said housing or said outer circumference of said core.

7. A method of coupling a plug and a receptacle of an electrical connector, the method comprising:

viewing a color through a window on the collar of the uncoupled electrical connector;

inserting the plug into the receptacle;

rotating a collar on the plug to engage a corresponding surface on the housing; and viewing a change in the color viewed through the window on the collar to determine whether the plug is fully coupled to the receptacle.

8. The method of claim 7, wherein viewing a change in color comprises first viewing a color, then viewing the absence of a color.

9. The method of claim 7, wherein viewing a change in color comprises viewing a first color, then viewing a second color.

* * * * *

UNITED STATES PATENT AND TRADEMARK OFFICE

CERTIFICATE OF CORRECTION

PATENT NO. : 7,497,723 B2
APPLICATION NO. : 11/763178
DATED : March 3, 2009
INVENTOR(S) : Robert Brassell et al.

It is certified that error appears in the above-identified patent and that said Letters Patent is hereby corrected as shown below:

Column 5

Claim 4, line 8, change “plus” to --plug--.

Signed and Sealed this

Sixteenth Day of June, 2009

JOHN DOLL
*Acting Director of the United States Patent and Trademark Office*